US010195663B2

(12) United States Patent
Blumenau et al.

(10) Patent No.: US 10,195,663 B2
(45) Date of Patent: Feb. 5, 2019

(54) ROBOTIC STORAGE AND RETRIEVAL SYSTEMS AND METHODS

(71) Applicant: Voodoo Robotics, Inc., Dallas, TX (US)

(72) Inventors: Trevor I. Blumenau, Plano, TX (US); Carlos A. Hoefken, Dallas, TX (US)

( * ) Notice: Subject to any disclaimer, the term of this patent is extended or adjusted under 35 U.S.C. 154(b) by 1243 days.

(21) Appl. No.: 14/010,207

(22) Filed: Aug. 26, 2013

(65) Prior Publication Data

US 2014/0060770 A1 Mar. 6, 2014

Related U.S. Application Data

(60) Provisional application No. 61/695,708, filed on Aug. 31, 2012.

(51) Int. Cl.
*B22D 33/00* (2006.01)

(52) U.S. Cl.
CPC ..... *B22D 33/00* (2013.01)

(58) Field of Classification Search
CPC ..... B22D 33/00
USPC ..... 700/214
See application file for complete search history.

(56) References Cited

U.S. PATENT DOCUMENTS 4,224,979 A * 9/1980 Rosin ..... B22D 33/00 164/130
4,705,445 A * 11/1987 Morita ..... B29C 45/1756 104/162
6,216,767 B1 * 4/2001 McMellon ..... B22D 33/00 164/167
2007/0080025 A1 * 4/2007 Yamada ..... B66F 9/07572 187/224
2007/0184139 A1 * 8/2007 Muranaka ..... B29C 35/007 425/143
2007/0289713 A1 * 12/2007 Crafton ..... B22D 47/02 164/4.1
2008/0301872 A1 * 12/2008 Fahrig ..... A61B 6/0457 5/81.1 R
2010/0191367 A1 * 7/2010 Grundmann ..... G06Q 10/08 700/224
2011/0106288 A1 * 5/2011 Catoen ..... B29C 45/76 700/108
2011/0106295 A1 * 5/2011 Miranda ..... B65G 1/1378 700/216
2012/0067539 A1 * 3/2012 Morgott ..... B22C 13/085 164/154.1
2013/0245810 A1 * 9/2013 Sullivan ..... G06Q 10/08 700/214

* cited by examiner

*Primary Examiner* — Kyle O Logan
(74) *Attorney, Agent, or Firm* — John Lindsay

(57) ABSTRACT

A system for storage and retrieval of items includes a shelving rack configured to store the items. The shelving rack has a plurality of vertical levels. The system includes at least one robotic carriage operable to move horizontally. The robotic carriage includes an extendable arm that extends horizontally and vertically to lift the items from an input slot and to carry and place the items on the shelving rack. The robotic carriage is also operable to lift the items from the shelving rack and to carry and place the items on a workstation. The workstation is positioned in close proximity to the shelving rack. By locating the workstation in close proximity to the shelving rack, the items may be transferred from the shelving rack to the workstation without requiring conveyors and ram drives.

12 Claims, 7 Drawing Sheets

ROBOTIC STORAGE AND RETRIEVAL SYSTEMS AND METHODS

RELATED APPLICATION

This Application is related to and claims priority from U.S. Provisional Patent Application No. 61/695,708, filed Aug. 31, 2012, which is incorporated herein for all purposes.

FIELD OF THE INVENTION

The invention relates generally to robotic storage and retrieval systems and methods and more particularly, the invention relates to robotic storage and retrieval systems and methods with configurable racks suitable for industrial applications.

BACKGROUND OF THE INVENTION

In many industrial applications, robots are used for storage and retrieval of items. In warehouses and foundries, shelving racks are constructed for storage of items. The shelving racks typically have multiple vertical levels on which items are stored on pallets. The robots, which move both vertically and horizontally between the shelving racks, place the pallets in the shelving racks and also pick up and carry the pallets away from the shelving racks.

In sand casting foundries, shelving racks may be used to store pallets. The pallets may hold molds, which may be empty or filled. The pallets may be transported and placed in a pouring area where molten metal is poured into the mold to form metal parts. Because the pouring area is generally located at a distance from the storage area, robots, conveyors and ram drives are needed to move the pallets from the storage area to the pouring area.

A typical storage and retrieval system in a foundry may have two input slots and two output slots. An empty mold is placed into the first input slot. A robot may pick up the empty mold from the first input slot and carry and place the mold in a shelving rack. Later, the robot may retrieve the empty mold and carry and place the mold in the first output slot. A conveyor may then move the empty mold to a pushing station. At the pushing station, a ram drive forces the mold across a pouring table. The process is continued until a predetermined number of empty molds are lined up on the pouring table. Since the pouring area is typically located away from the shelving racks, powered conveyors and ram drives are needed to move the pallet to the pouring area.

At the pouring area, a crucible of molten metal is moved into place over the empty molds and tipped over to pour the molten metal into the empty molds. After the molds are filled with the molten metal, the filled molds, each weighing approximately 4000 lbs., are left for a predetermined time period for a "skin" to form at the boundary between the mold and the metal. Once the filled molds can be safely moved, the ram drive slowly pushes the filled molds back onto a second conveyor, which moves the filled molds to the second input slot. The robot then picks up and carries the filled molds to the shelving rack or to a separate resting slot. The filled molds are allowed to rest for a predetermined time period to allow the molds to cool. Thereafter, the robot carries the filled molds to the second output slot. The filled molds are then moved to a shaker where metal parts are separated from the molds.

Thus, it will be apparent that conventional systems are complex and inefficient because they require conveyors and a ram drive. Also, conventional systems require a large area because the conveyors and the ram drive must be installed. Accordingly, improved systems and methods are needed.

SUMMARY OF THE INVENTION

According to some disclosed embodiments, a system for storage and retrieval of items includes a shelving rack configured to store the items. The shelving rack has a plurality of vertical levels. The system includes at least one robotic carriage operable to move horizontally. The robotic carriage includes an extendable arm that extends horizontally and vertically to lift the items from an input slot and to carry and place the items on the shelving rack. The robotic carriage is also operable to lift the items from the shelving rack and to carry and place the items on a workstation. The workstation is positioned in close proximity to the shelving rack. By locating the workstation in close proximity to the shelving rack, the items may be transferred from the shelving rack to the workstation without requiring conveyors and ram drives. Also, by locating the workstation in close proximity to the shelving rack, the time required to transfer the items from the shelving rack to the workstation is reduced.

According to some disclosed embodiments, the system may include a second robotic carriage operable to move horizontally. The second robotic carriage has an extendable arm operable to extend horizontally and vertically to lift the items from the shelving rack and to carry and place the items on the workstation.

According to some disclosed embodiments, the system includes one or more load sensors configured to determine the weight of the item. Based on the weight of the item, the speed of the robotic carriage is adjusted. The load sensors may be positioned in the robotic carriage, in the input slot, in the workstation, or in any other suitable location.

According to some disclosed embodiments, the system includes a control server connected to the load sensor via a communication link. The communication link may be a wireless link, a wired link or any other suitable communication link. The control server is configured to control the operation of the system including the robotic carriages. When the load sensor detects that an item has been placed on the workstation, the control server instructs the robotic carriage to retrieve the item from the workstation. The robotic carriage may be instructed to retrieve the item from the workstation after a predetermined time period.

According to some disclosed embodiments, the items are pallets containing empty molds or filled molds. The workstation may be a pouring station that receives the pallets containing empty molds from the robotic carriage. Thereafter, molten metal is poured over the empty molds to form metal parts. The robotic carriage may retrieve the molds a predetermined time period after the empty molds are filled with molten metal.

According to some disclosed embodiments, the control server sends a first control signal to the robotic carriage after the molten metal in the mold solidifies, and in response the robotic carriage retrieves the filled mold from the pouring station. According to some disclosed embodiments, the robotic carriage rides on a track parallel to the shelving rack to service the entire length of the shelving rack.

According to some disclosed embodiments, the items are cartons or boxes.

According to some disclosed embodiments, the control server is configured to monitor the shelving rack and to transmit a status message. A graphical user interface is connected to the control server via a communication link.

The graphical user interface displays the shelving rack and position of the robotic carriages responsive to the status message. A user can control the operation of the robotic carriage via the graphical user interface.

As referred to hereinabove and throughout, the "present invention" refers to one or more exemplary embodiments of the present invention, which may or may not be claimed, and such references are not intended to limit nor be imported into the language of the claims, or to be used to construe the claims in a limiting manner.

BRIEF DESCRIPTION OF THE DRAWINGS

The objects and features of the invention will become more readily understood from the following detailed description and appended claims when read in conjunction with the accompanying drawings in which like numerals represent like elements.

The drawings constitute a part of this specification and include exemplary embodiments to the invention, which may be embodied in various forms. It is to be understood that in some instances various aspects of the invention may be shown exaggerated or enlarged or simply as an illustration to facilitate an understanding of the invention.

DETAILED DESCRIPTION OF THE PREFERRED EMBODIMENTS

The following description is presented to enable any person skilled in the art to make and use the invention, and is provided in the context of a particular application and its requirements. Various modifications to the disclosed embodiments will be readily apparent to those skilled in the art, and the general principles defined herein may be applied to other embodiments and applications without departing from the spirit and scope of the present invention. Thus, the present invention is not intended to be limited to the embodiments shown, but is to be accorded the widest scope consistent with the principles and features disclosed herein. As used herein, "substantially" is to be construed as a term of approximation.

Figure 1:
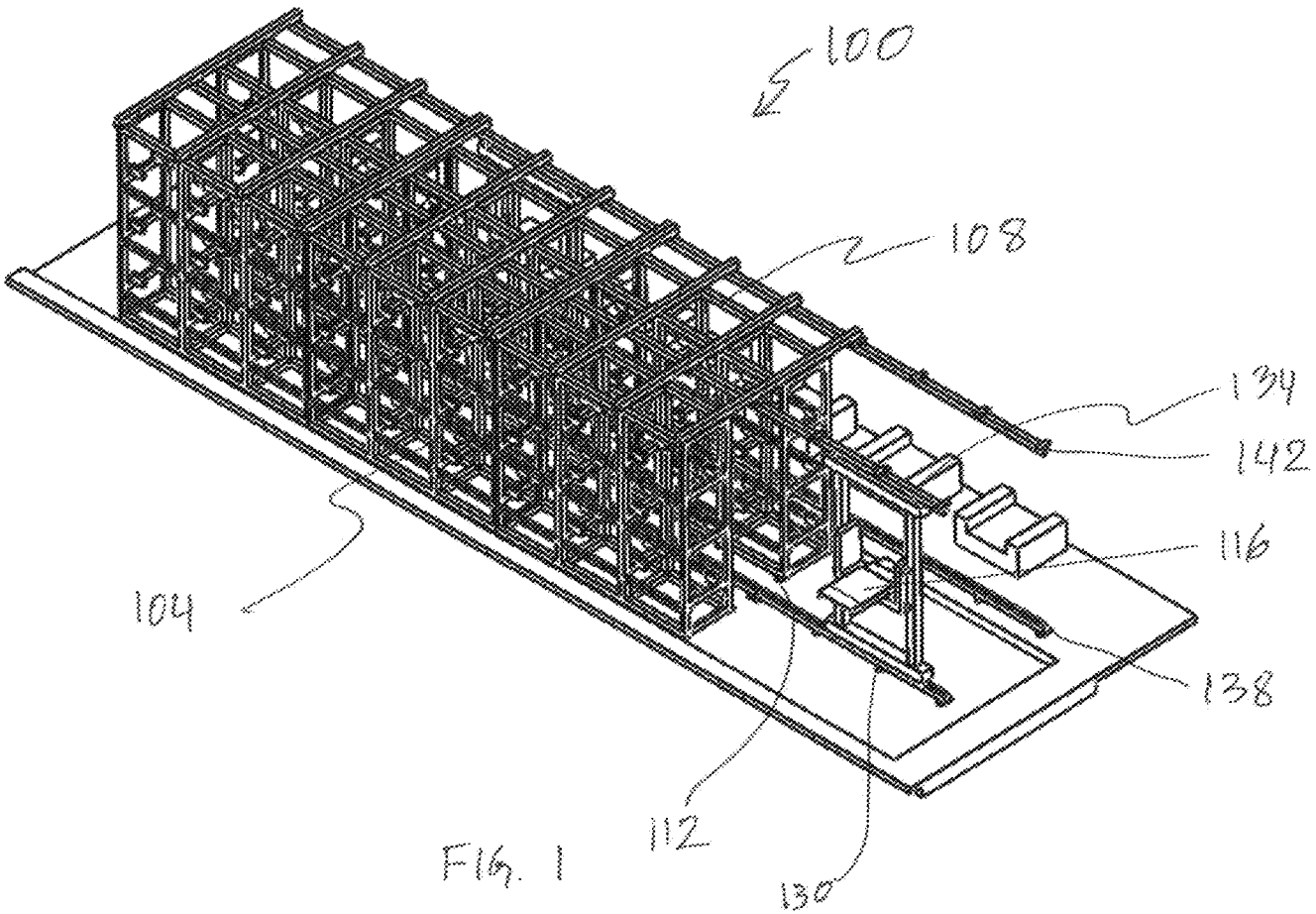
FIG. 1 shows a perspective view of a system according to some disclosed embodiments.

FIG. 1 illustrates a perspective view of storage and retrieval system 100 according to some disclosed embodiments. System 100 may, for example, be configured for use in warehouses or foundries. System 100 may be configured for use in sand casting process, which is a metal casting process characterized by using sand as the mold material. It will be appreciated that in foundries objects such as metal parts are fabricated via sand casting process.

Referring again to FIG. 1, system 100 includes shelving racks 104 and 108 having a plurality of vertical levels. Shelving racks 104 and 108 are configured to store items such as, for example, pallets, cartons or boxes. According to some disclosed embodiments, shelving racks 104 and 108 may be configured to store pallets. Molds, which are used in sand casting process, may sit on the pallets.

While system 100 is shown as having two shelving racks 104 and 108, it will be apparent that system 100 may be configured to include only one shelving rack or more than two shelving racks. Shelving racks 104 and 108 can be expanded horizontally as well as vertically. Also, the shelving racks may be configured as horizontally arranged compartments.

According to some disclosed embodiments, shelving racks 104 and 108 are constructed generally parallel to one another with rack aisle 112 in between. System 100 includes first robotic carriage 116 that moves along rack aisle 112 between shelving racks 104 and 108 to service the entire length of shelving racks 104 and 108. System 100 may include second robotic carriage (not shown in FIG. 1) that moves in front of shelving rack 108 to service shelving rack 108. System 100 may be configured to operate with only a single robotic carriage or may be configured to operate with a plurality of robotic carriages. The robotic carriages are configured to lift items from the shelving racks and carry and place the items in designated areas.

According to some disclosed embodiments, system 100 includes lower and upper tracks (or rails) 130 and 134 between shelving racks 104 and 108. Lower track 130 is laid on ground while upper track 134 is positioned vertically above lower track 130. Lower and upper tracks 130 and 134 support and guide robotic carriage 116 as it moves between shelving racks 104 and 108.

System 100 also includes lower and upper tracks (or rails) 138 and 142 in front of shelving rack 108. Lower track 138 is laid on ground generally parallel to shelving rack 108 while upper track 142 is positioned vertically above lower track 138. Lower and upper tracks 138 and 142 support and guide second robotic carriage as it moves parallel to shelving rack 108.

Figure 2:
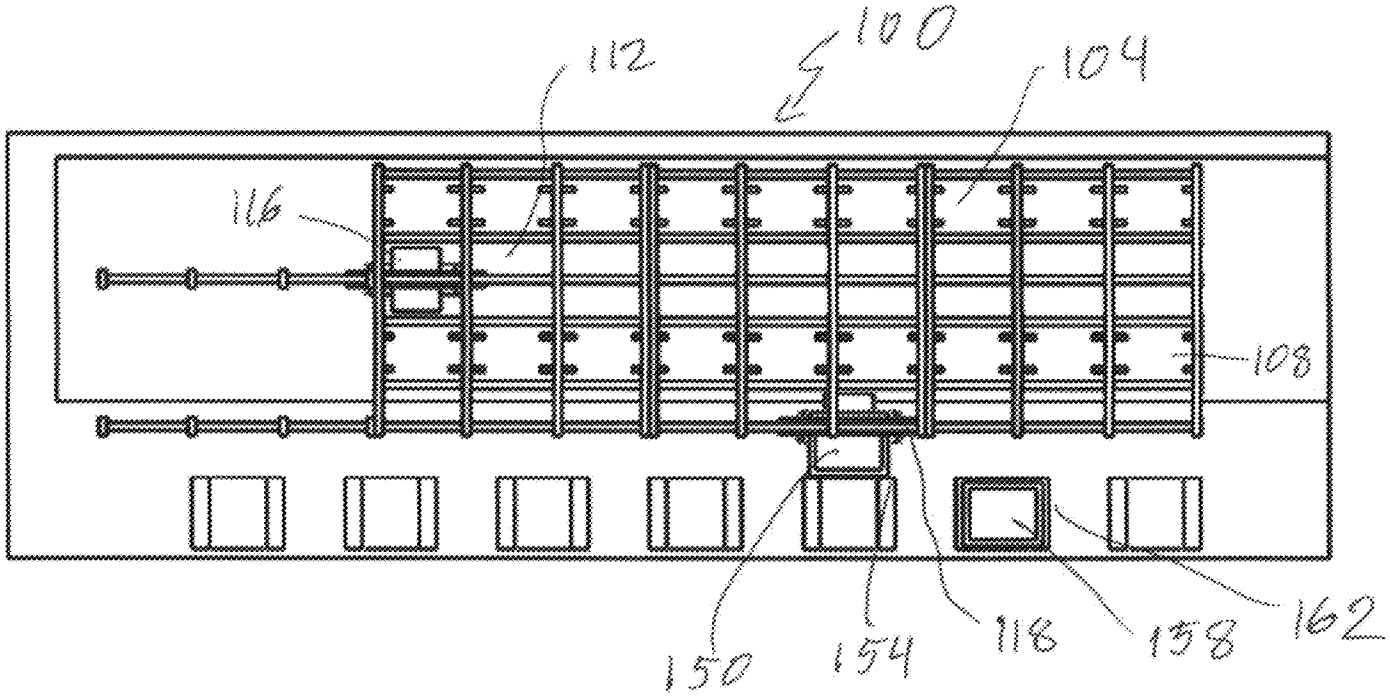
FIG. 2 illustrates a top orthogonal view of the system according to some disclosed embodiments.

FIG. 2 illustrates a top orthogonal view of system 100 according to some disclosed embodiments. Robotic carriage 116 is located on rack aisle 112 between shelving racks 104 and 108. Robotic carriage 116 is shown not holding any item while robotic carriage 118 is shown holding item 150. Item 150 may be a pallet containing a mold used for sand casting. Robotic carriage 118 is in the process of delivering the pallet to workstation 154 while pallet 158 has already been delivered to workstation 162. Workstations 154 and 162 may be pouring areas configured to receive the pallets. A crucible (not shown in FIG. 2) of molten metal is placed over the empty molds and tipped to pour molten metal into the empty molds to form metal parts.

According to disclosed embodiments, workstations 154 and 162 are placed in proximity to the shelving racks 104 and 108 to allow the robotic carriage 118 to transfer the items from the shelving racks directly to the workstations without requiring conveyors and ram drives, thus reducing complexity and cost of system 100. Also, by placing the workstations in proximity to the shelving racks, the time required to transfer a pallet from the shelving rack to the workstation is reduced.

Figure 3:
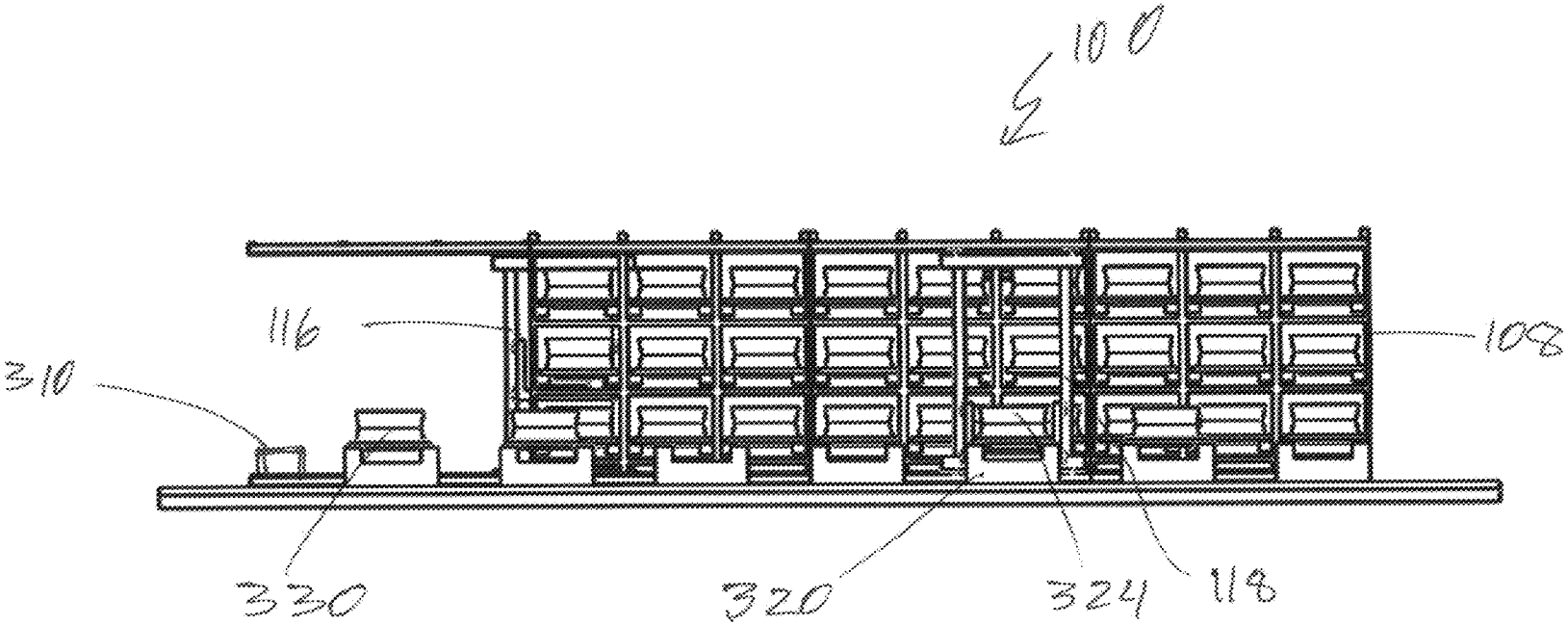
FIG. 3 shows a front orthogonal view of the system according to some disclosed embodiments.

FIG. 3 shows a front orthogonal view of system 100. Robotic carriage 116 may lift a pallet containing a mold from input slot 310, and carry and store the pallet in a shelving rack. Thereafter, robotic carriage 118 may retrieve the pallet from the shelving rack and deliver the pallet to a pouring area for sand casting. Robotic carriage 118 is shown in front of shelving rack 108 holding pallet containing mold 324 as it is delivered to pouring station 320. Another pouring station already holds mold 330.

According to some disclosed embodiments, system 100 may be configured to operate with only a single robotic carriage (e.g., robotic carriage 116). Accordingly, robotic carriage 116 may lift a pallet from an input slot and carry and store the pallet in a shelving rack. Subsequently, robotic carriage 116 may retrieve the pallet from the shelving rack and place the pallet on a workstation such as a pouring area.

Figure 4:
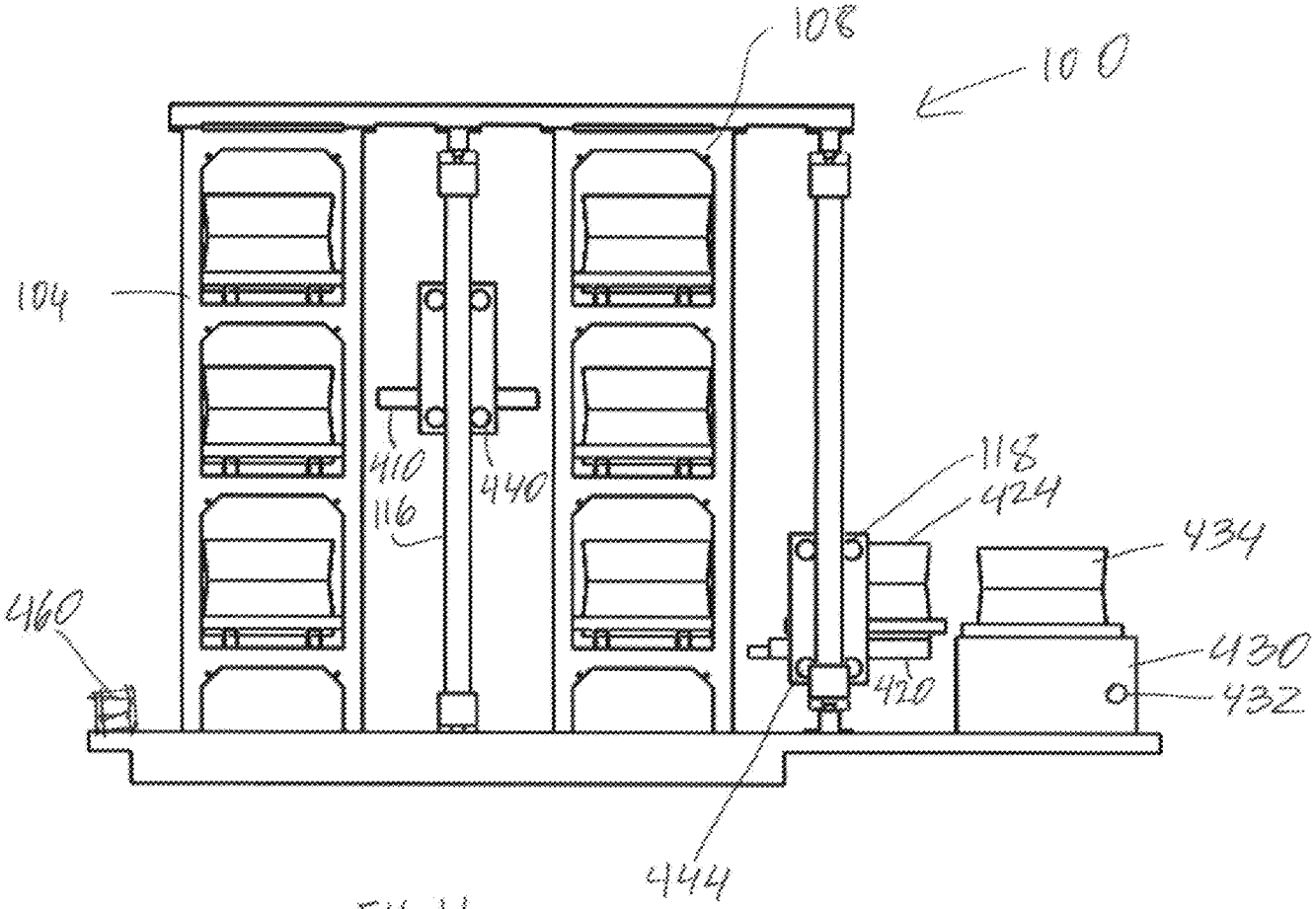
FIG. 4 is a side orthogonal view of the system according to some disclosed embodiments

According to some disclosed embodiments, robotic carriages 116 and 118 have extendable arms that extend horizontally and vertically to lift and carry the pallets. FIG. 4 is a side orthogonal view of system 100, which shows robotic carriage 116 between shelving racks 104 and 108. Robotic carriage 116 has extendable arm 410 that extends horizontally and vertically to lift and carry items from the shelving racks. Robotic carriage 116 may include a horizontal propulsion system, which enables arm 410 to extend and retract. Also, robotic carriage 116 may include a vertical lift mechanism enabling extendable arm 410 to vertically move. Similarly robotic carriage 118, shown in front of shelving rack 108, has extendable arm 420 that moves horizontally and vertically. In FIG. 4, robotic carriage 118 is shown holding mold 424 on its extendable arm as the mold is delivered to a pouring station, while another pouring station 430 is shown holding mold 434.

According to some disclosed embodiments, robotic carriage 116 may include load sensor 440 configured to determine the weight of the item on its extendable arm. Based on the weight of the item, the speed of robotic carriage 116 may be adjusted. For example, if robotic carriage 116 carries a relatively heavy item, the speed of robotic carriage 116 is decreased so that the heavy item can be transported safely. Conversely, if the item is relatively light, the speed of robotic carriage 116 is increased. Likewise, robotic carriage 118 includes load sensor 444 configured to determine the weight of the item on its extendable arm. Similar load sensors may be installed in an input slot to determine the weight of the items and also to detect when an item is placed thereon.

According to some disclosed embodiments, system 100 includes one or more workstations (e.g., pouring stations) having load sensors 432 configured to detect a placement of an item on the workstation and the weight of the item. For example, as shown in FIG. 4, pouring station 430 includes load sensor 432 configured to measure the weight of an item on the pouring station. More specifically, load sensor 432 may be configured to detect that molten metal is being poured into an empty mold. The load sensor may be connected to control server 460 via a wireless communication link. According to disclosed embodiments, load sensor 432 may transmit a first control signal to control server 460 when an item is placed on the workstation. In response, control server 460 may instruct robotic carriage 118 to retrieve the item from the workstation after a predetermined time period. For example, control server 460 may instruct robotic carriage 118 to retrieve a pallet from the workstation (e.g., pouring station) a predetermined time period after molten metal is poured in an empty mold. This predetermined time period is generally sufficient for the mold to be filled with the molten metal and for the molten metal to begin to solidify so that the filled mold can be safely moved. In response to the first control signal, robotic carriage 118 lifts the filled mold from the pouring station and carries the item for storage.

According to some disclosed embodiments, the load sensors may include electronic sensors configured to measure current flowing through a motor when an item such as a pallet is placed on a robotic carriage, an input slot or a workstation. Based on the measured current flowing through the motor, the load sensor may determine the weight of the item. The load sensor determines the weight of the item based on the current flowing through the motor when the item is supported, carried, lifted or placed down. The load sensor may then transmit a message, which contains the measured weight, to a control server via a wireless communication link.

Figure 5:
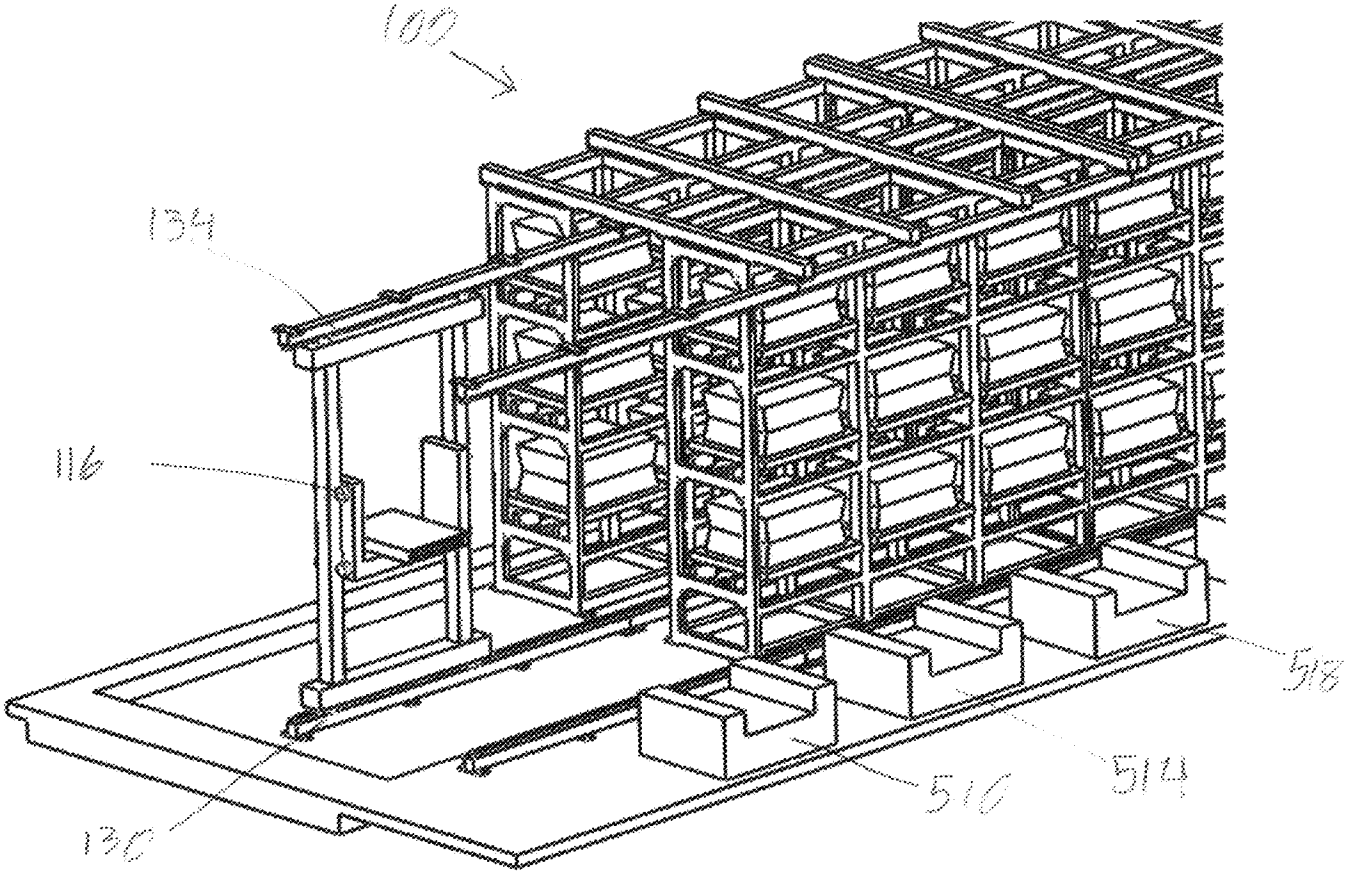
FIG. 5 is a front side perspective view of the system.

FIG. 5 is a front side perspective view of system 100. Robotic carriage 116 is shown on tracks 130 and 134. FIG. 5 also shows pouring stations 510, 514 and 518 that are empty.

Figure 6:
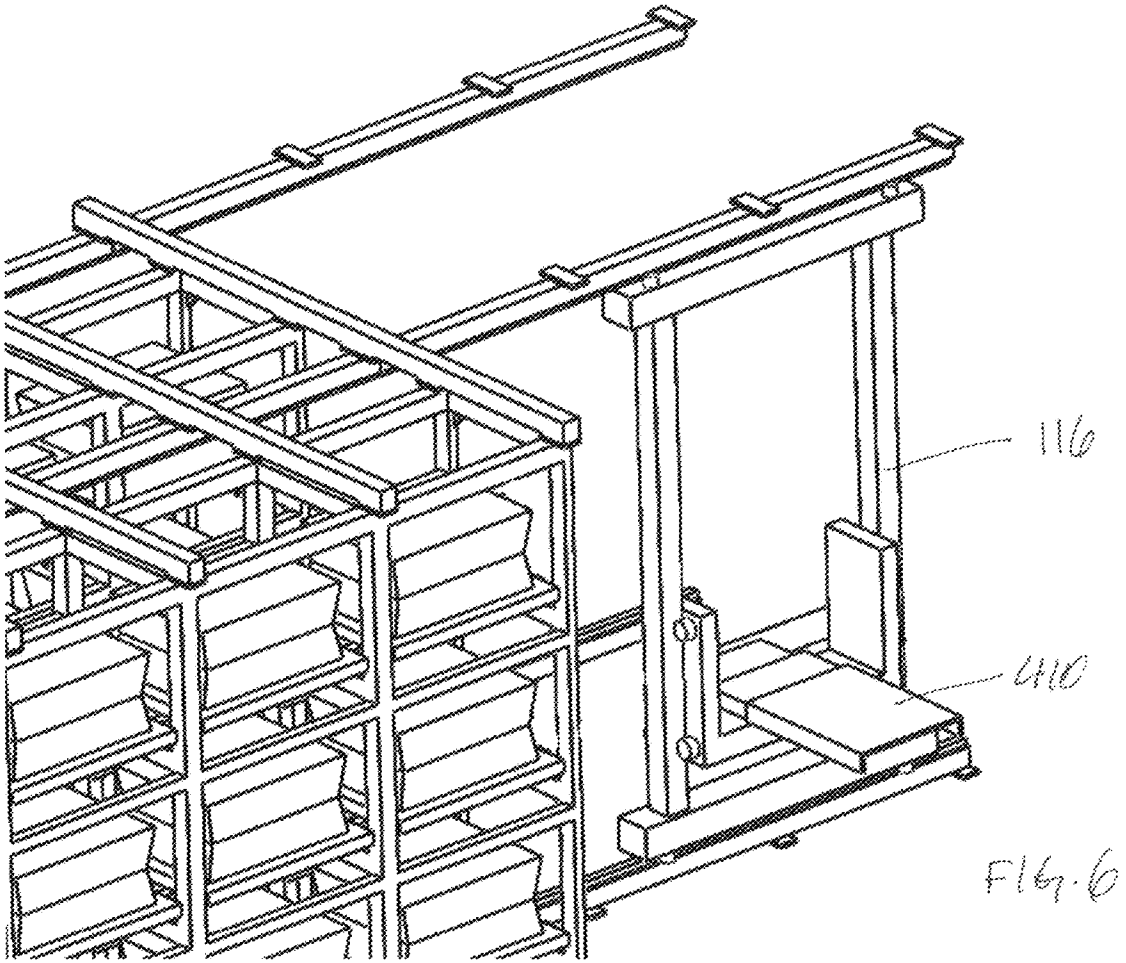
FIG. 6 is a perspective view of a robotic carriage according to some disclosed embodiments.

FIG. 6 is a perspective view of robotic carriage 116. Robotic carriage 116 has extendable arm 410 that extends horizontally and vertically to lift and carry items (not shown in FIG. 6) from the shelving racks. As discussed before, robotic carriage 116 may include a horizontal propulsion system, which enables extendable arm 410 to extend and retract.

Figure 7:
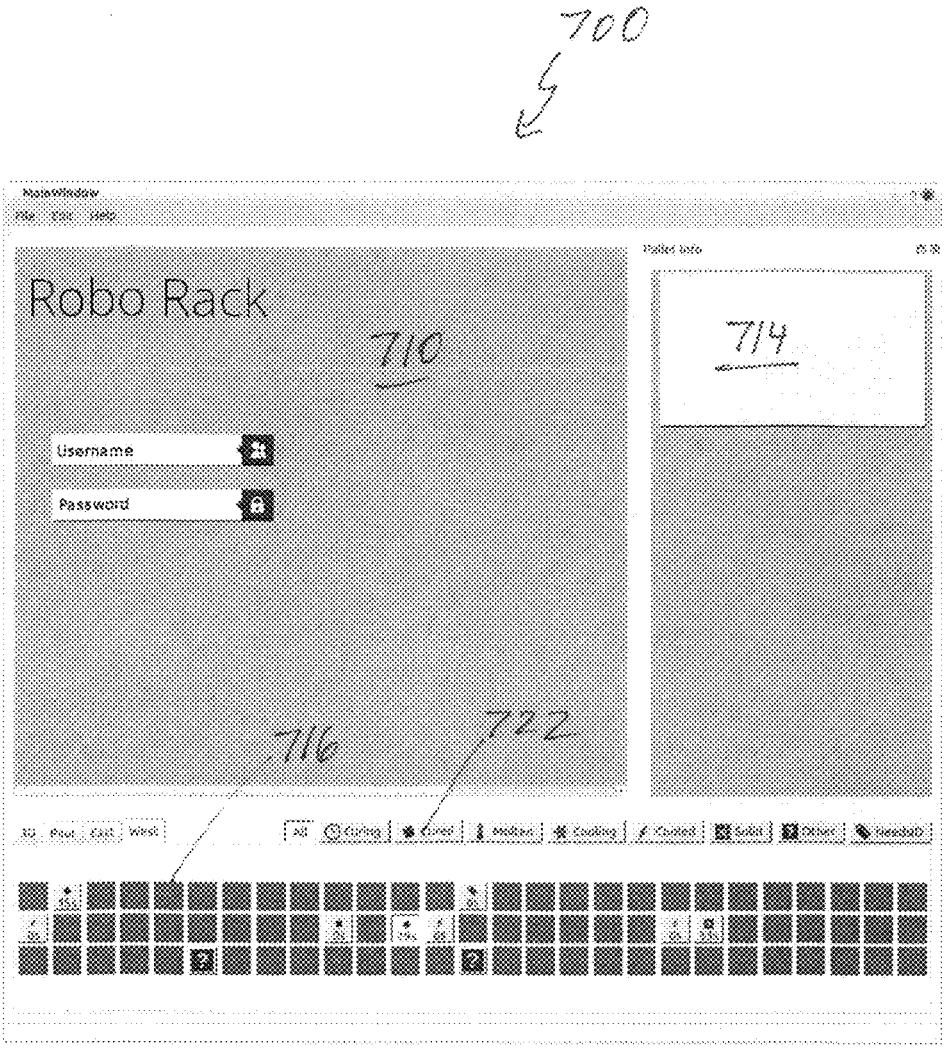
FIG. 7 illustrates a graphical user interface.

FIG. 7 illustrates graphical user interface 700 for system 100. Graphical user interface 700 provides a visual representation of system 100, and allows a user to control system 100 via the graphical user interface. Main area 710 allows a user to logon to the system using a username and a password. Area 714 displays information about pallets. A visual representation of each rack is provided in area 716. A pallet is represented by an icon 718. Buttons 722 can be used to select multiple pallets. Graphical user interface 700 may be connected to a control server via a communication link. The control server monitors system 100 and provides status information, which may be displayed on graphical user interface. A user may control the operation of a robotic carriage via graphical user interface. For example, using the graphical user interface, a user may instruct a robotic carriage to transfer an item from the shelving rack to a workstation.

It will be readily apparent to those skilled in the art that the general principles defined herein may be applied to other embodiments and applications without departing from the spirit and scope of the present invention. Having thus described the exemplary embodiments, it is noted that the embodiments disclosed are illustrative rather than limiting in nature and that a wide range of variations, modifications, changes, and substitutions are contemplated in the foregoing disclosure and, in some instances, some features of the present invention may be employed without a corresponding use of the other features. Many such variations and modifications may be considered desirable by those skilled in the art based upon a review of the foregoing description of preferred embodiments. Accordingly, it is contemplated that the appended claims will cover any such modifications or embodiments that fall within the true scope of the invention.

What is claimed is:

1. A system for storage and retrieval of items, comprising:

expandable shelving racks configured to store the items, the shelving racks having a plurality of vertical levels;

at least one robotic carriage operable to move horizontally, the robotic carriage having a an extendable arm operable to extend horizontally and vertically to lift the items from an input slot and to carry and place the items on the shelving racks;

the robotic carriage operable to lift the items from the shelving racks and to automatically carry and place the items on a workstation, wherein the workstation is placed in close proximity to the shelving rack;

said robotic carriage located and operating on the rear of said shelving racks; and a second robotic carriage located on the front of said shelving racks, simultaneously operable to move horizontally, the second robotic carriage having an extendable arm operable to extend horizontally and vertically to lift the items from the shelving rack and to carry and place the items on the workstation.

2. A system for storage and retrieval of items, comprising:

expandable shelving racks configured to store the items, the shelving racks having a plurality of vertical levels;

at least one robotic carriage operable to move horizontally, the robotic carriage having an extendable arm operable to extend horizontally and vertically to lift the items from an input slot and to carry and place the items on the shelving racks;

the robotic carriage operable to lift the items from the shelving racks and to automatically carry and place the items on a workstation, wherein the workstation is placed in close proximity to the shelving rack;

wherein the robotic carriage includes a load sensor configured to determine the weight of the item on the extendable arm, wherein the speed of the robotic carriage is adjusted based on the weight of the item;

a second load sensor is located in the input slot to determine the weight of the items and detect when an item is placed thereon.

3. The system of claim 2, wherein the items are pallets containing empty molds or filled molds.

4. The system of claim 3, wherein the control server sends a first control signal to the robotic carriage after the molten metal in the mold solidifies and in response the robotic carriage is operable to retrieve the molds a predetermined time period after said control signal.

5. The system of claim 3, wherein the workstation is a pouring station configured to receive the pallets containing empty molds from the robotic carriage, wherein molten metal is poured over the empty molds to form metal parts.

6. The system of claim 5, wherein the robotic carriage is operable to retrieve the molds a predetermined time period after the empty molds are filled with molten metal.

7. A system for storage and retrieval of items, comprising:

expandable shelving racks configured to store the items, the shelving racks having a plurality of vertical levels;

at least one robotic carriage operable to move horizontally, the robotic carriage having an extendable arm operable to extend horizontally and vertically to lift the items from an input slot and to carry and place the items on the shelving racks;

the robotic carriage operable to lift the items from the shelving racks and to automatically carry and place the items on a workstation, wherein the workstation is placed in close proximity to the shelving rack;

a control server configured to monitor the shelving rack and to generate a status message;

a graphical user interface connected to the control server via a communication link, the graphical user interface displaying the shelving rack and position of the robotic carriages responsive to the status message.

8. The system of claim 7, wherein the graphical user interface is configured to control the operation of the robotic carriage via the control server.

9. A system for storage and retrieval of items, the system comprising:

a shelving rack configured to store the items, the shelving rack having a plurality of vertical levels;

plural tracks located between said shelving rack levels said tracks supporting and guiding a robotic carriage as it moves parallel to said shelving rack levels;

the robotic carriage operable to move horizontally, the robotic carriage having an extendable arm operable to extend horizontally and vertically to lift the items from an input slot and to carry and place the items on the shelving rack, a load sensor configured to determine the weight of the item;

wherein the load sensor is located in the input slot to determine the weight of the items and detect when an item is placed thereon; and a control server linked to the load sensor via a communication link, the control server operable to control the speed of the robotic carriage based on the weight of the item;

a workstation placed in close proximity to the shelving rack, wherein the robotic carriage is operable to automatically move the items from the shelving rack to the workstation.

10. The system of claim 9, wherein the control server sends a first control signal to the robotic carriage a predetermined time period after the empty molds are filled with molten metal, and wherein responsive to the first control signal the robotic carriage lifts and carries the filled molds from the workstation.

11. A system for storage and retrieval of items, the system comprising:

a shelving rack configured to store the items, the shelving rack having a plurality of vertical levels;

plural tracks located between said shelving racks said tracks supporting and guiding said robotic carriage as it moves parallel to said shelving racks;

a robotic carriage operable to move horizontally, the robotic carriage having an extendable arm operable to extend horizontally and vertically to lift the items from an input slot and to carry and place the items on the shelving rack, a load sensor configured to determine the weight of the item;

a control server linked to the load sensor via a communication link, the control server operable to control the speed of the robotic carriage based on the weight of the item;

a workstation placed in close proximity to the shelving rack, wherein the robotic carriage is operable to automatically move the items from the shelving rack to the workstation;

wherein the control server monitors the cooling state of the molds and provides feedback to an operator via a graphical user interface;

wherein the control server monitors the shelving racks and provides status information via a graphical user interface, wherein the status information indicates state or condition of the items and identification of the items.

12. The system of claim 11, wherein the graphical user interface is configured to control the operation of the robotic carriage via the control server, with buttons representing pallets for controlled operations.

* * * * *